United States Patent [19]

Shoji et al.

[11] Patent Number: 4,485,652

[45] Date of Patent: Dec. 4, 1984

[54] METHOD OF CONTROLLING ROLLING APPARATUS

[75] Inventors: Morio Shoji; Akiyoshi Yamamoto, both of Hyogo, Japan

[73] Assignee: Mitsubishi Denki Kabushiki Kaisha, Tokyo, Japan

[21] Appl. No.: 470,451

[22] Filed: Feb. 28, 1983

[30] Foreign Application Priority Data

Mar. 1, 1982 [JP] Japan ..... 57-33192
May 27, 1982 [JP] Japan ..... 57-91666

[51] Int. Cl.[3] ..... B21B 37/08
[52] U.S. Cl. ..... 72/19; 72/202
[58] Field of Search ..... 72/7, 11, 19, 202; 364/472, 511

[56] References Cited

U.S. PATENT DOCUMENTS 3,839,628 10/1974 Higgins et al. ..... 364/511
3,841,147 10/1974 Coil et al. ..... 364/511
4,351,029 9/1982 Maxey et al. ..... 364/511

OTHER PUBLICATIONS

Brower, A. S., "Controlling a Complete Hot Strip Mill", *Control Engineering,* Oct. 1963, p. 57–63.

*Primary Examiner*—E. Michael Combs
*Assistant Examiner*—Charles Rosenberg
*Attorney, Agent, or Firm*—Bernard, Rothwell & Brown

[57] ABSTRACT

A method for controlling a rolling apparatus in which heated materials are successively extracted from heating ovens to be rolled with rollers and each extracting interval time between the materials is controlled such that the maximum root mean square valve of power supplied to motor for driving the rollers is less than the permissible root mean square power valve of the driving motors in any one of the rolling passes.

5 Claims, 7 Drawing Figures

METHOD OF CONTROLLING ROLLING APPARATUS

BACKGROUND OF THE INVENTION

1. Field of the Invention

This invention relates to a method of controlling a rolling apparatus for rolling material to a predetermined thickness through a plurality of rolling passes and, more particularly, to a method of controlling a rolling apparatus such as to obtain optimum rolling with given rolling conditions.

2. Description of the Prior Art

To obtain efficient rolling of material to a desired thickness, it is necessary to set a rolling schedule in correspondence to various control parameters such as the gap and rotational speed of the roller for each rolling pass, thickness and temperature of the material, a motor torque for driving each roller, etc.

It is well known in the art that where a material is continuously rolled through a plurality of rolling passes, an i-th pass of coarse rolling process has a following equational relationship between the thickness $H_i$ of the material, the thickness $h_i$ of the material at the roller outlet, the rolling speed $V_i$ and the rolling force $F_i$ $$F_i=f_1(H_i, h_i, V_i) \quad (1)$$

The motor power $PW_i$ required for executing the i-th pass is given as $$PW_i=f_2(F_i, V_i) \quad (2)$$

The rolling speed $V_i$ is set such that $V_{MIN} \leqq V_i \leqq V_{MAX}$ wherein $V_{MAX}$ and $V_{MIN}$ are respectively the maximum speed and minimum speed and that the power $PW_i$ is less than the maximum permissible value. Once the thickness $h_i$ and rolling force $F_i$ are determined, the position or gap of roller is calculated according to an equation $$S_i=f_3(F_i, h_i) \quad (3)$$

Once these control parameters are determined, the required number of passes and the minimum time required for the completion of the rolling can be obtained, whereby the rolling schedule can be determined. The fine rolling carried out subsequent to the coarse rolling, however, is controlled not with the minimum rolling time as goal but with the fine crown, etc. as the parameters determining according to the rolling schedule. The rolling time is thus determined by the length of the material and the thickness reduction to be obtained by rolling. In other words, the rolling schedule for the fine rolling is set such as to provide a predetermined finish precision of the product.

The rolling schedule is thus set according to a certain rolling goal and the specifications of the rolling apparatus such as the rolling pressure may be satisfied, but the ratings of the motor for driving the roller are not always satisfied. This means that it is liable that the motor is continuously driven in an overloaded condition. In such a case, the motor coil insulation and lubrication would be deteriorated due to heat generation, which result in motor troubles. Further, in the case of the minimum time rolling, there is no guarantee that the minimum necessary power be supplied, so that the power efficiency is inferior.

SUMMARY OF THE INVENTION

An object of the invention is to provide a method of controlling a rolling apparatus such that the load on the motor for driving the roller will be optimum.

Another object of the invention is to provide a method of controlling a rolling apparatus, which can increase its operational efficiency and thereby reduce its required power consumption in the rolling.

A further object of the invention is to provide a method of controlling a rolling apparatus, which permits the minimum rolling time to be set under given conditions without overloading every roller driving motor of the apparatus.

DETAILED DESCRIPTION OF THE PREFERRED EMBODIMENTS

Figure 1:
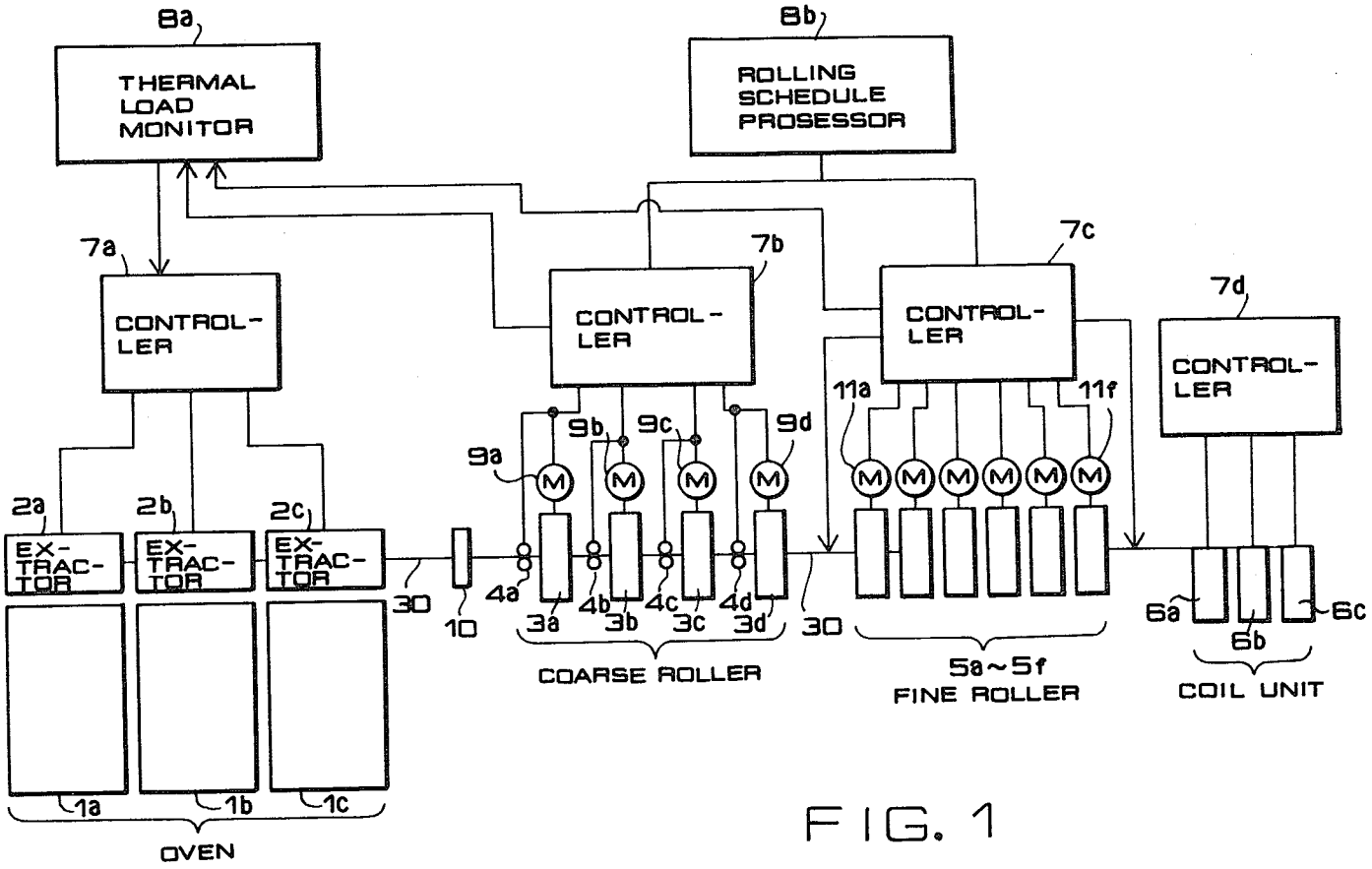
FIG. 1 is a block diagram showing a rolling apparatus which is controlled by the method of control according to one embodiment of the invention.

FIG. 1 is a block diagram showing a rolling apparatus controlled by the control method according to one embodiment of the invention. Each material to be rolled is respectively heated in ovens 1*a* to 1*c* to a predetermined temperature and then taken out by extractors 2*a* to 2*c* to be fed onto a transport table 30. The extractors 2*a* to 2*c* are controlled by an extractor controller 7*a*. The material then passes through a scale breaker 10 and is continuously rolled by vertical rollers 4*a* to 4*d* and coarse rollers 3*a* to 3*d* down to a thickness of a predetermined value. The rollers 3*a* to 3*d* are driven by respective motors 9*a* to 9*d*, and the motors 9*a* to 9*d* and vertical rollers 4*a* to 4*d* are controlled by a controller 7*b*. The material is then rolled by fine rollers 5*a* to 5*f* to a goal thickness as it is transported over the transport table. The fine rollers 5*a* to 5*f* are driven by respective motors 11*a* to 11*f*, which are controlled by a controller 7*c*. The material having passed through the roller 5*f* is transported to take-up coil units 6*a* to 6*c* to be taken up into coil thereon. The coil units 6*a* to 6*c* are controlled by a controller 7*d*.

The controller 7*a* is supervisorly controlled by a thermal load monitor 8*a*, to which rolling data from the controllers 7*b* and 7*c* are supplied. The controllers 7*b* and 7*c* control the rollers 4*a* to 4*d*, motors 9*a* to 9*d* and 11*a* to 11*f* and transport table 30 according to rolling schedule data supplied from a rolling schedule processor 8*b*. The rolling schedule is set through the following steps.

(a) Setting of root mean square current $I_{RMS}$: The thermal load state of each of the motors 9*a* to 9*d* and 11*a* to 11*f* may be represented by root mean square current $I_{RMS}$ which is the ratio between the root mean square of current i through each and the rated current $I_{oi}$ therewith. The current $I_{RMS}$ is thus given as $$I_{RMS} = \frac{\sqrt{\frac{\int_t^{t+\tau} I_i^2 dt}{\tau}}}{I_{oi}} \quad (4)$$

where $\tau$ is the time interval between the start of the i-th pass rolling till the start of the next (i+1)-th pass rolling, i.e., the monitoring time interval.

Figure 2:
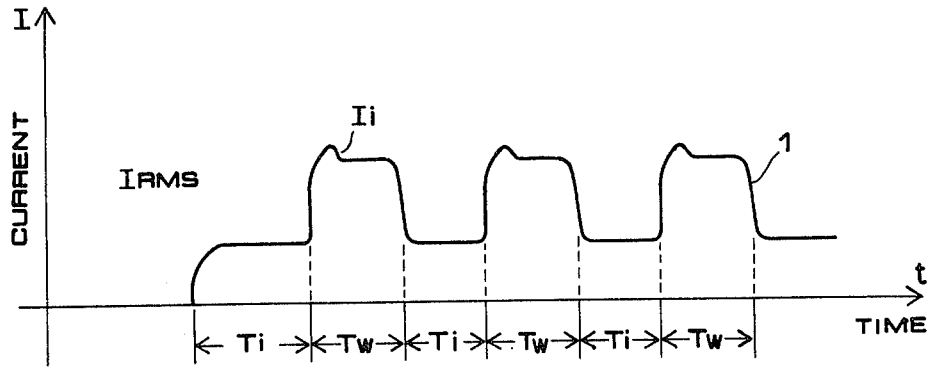
FIG. 2 is a graph showing the waveform of current through a roller driving motor.

As is seen from the equation 4, the current $I_{RMS}$ is reduced with reducing motor current $I_i$ provided that the monitoring time $\tau$ is constant. In order to fulfill maximum performance of the rolling mill, it is necessary to maintain a predetermined distance between successive blooms or slabs being transported over the transport table lest one should be struck by the preceding or succeeding one. In such rolling schedule, the motor current has a waveform as shown in FIG. 2. It will be seen from the illustrated current waveform that the current $I_{RMS}$ may be reduced by increasing the idle time $T_i$ of the pertinent roller. That is, to this end the time interval, at which the extractors 2a to 2c take out the material from the oven 1a, 1b or 1c, may be increased.

(b) Setting of pitch correction amount: Assuming the monitoring time $\tau_i$ to be the period between the start of rolling with the roller corresponding to the i-th pass and the start of next rolling with the roller corresponding to the (i+1)-th pass, the correction value $\Delta P_i t_i$ of the rolling time interval, i.e., pitch, at which the materials are alternatively taken out from each oven 1a–1c is calculated according to an equation $$P_i t_i = \frac{\int_t^{t+\tau_i} I_i^2 dt}{I_{RMSO}^2 + I_{oi}^2} = t_i \quad (5)$$

wherein $I_{RMSO}$ is the root mean square value of the maximum permissible motor current. Of the motors 9a to 9d and 11a to 11f, the one which has the maximum correction value $\Delta P_i t_i$ is selected as the common required correction amount for all motors in regard to the thermal loading. The other factors for the pitch correction include those for prevention of collision between slabs on the rolling line and the state of heating of the material in each oven. These factors are included as factors for setting the extraction pitch.

Figure 3:
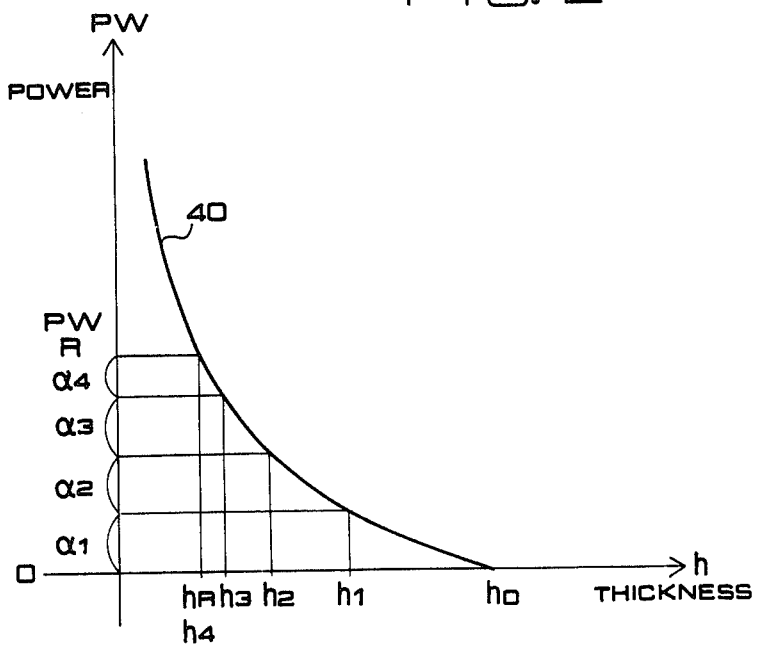
FIG. 3 is a graph showing the relationship between power required for driving roller and thickness of material.

(c) Setting of thickness $h_i$, $H_i$: The thickness setting parameters include the dimensions of the material, i.e., slab, temperature and substance of slab, goal dimensions after coarse rolling, coil dimensions after final fine rolling, fine roller outlet temperature, rolling speed of the final fine roller 5f and load share ratios of the individual rollers. A characteristic power versus thickness curve or power curve as shown in FIG. 3 is set for each roller. More particularly, the accumulated power PW of rolling is given as a function $$PW = f_{10}(h, h_0, W_0, k_5) \quad (6)$$

wherein h is the goal thickness, $h_0$ is the initial thickness, $W_0$ is the initial width and $k_5$ is a coefficient representing the substantial kind of material.

Thus, once the thickness $h_0$ at the inlet of the roller 3a and the thickness $h_R$ at the outlet of the roller 3d are given, the accumulated power PW necessary for the coarse rolling is obtained according to the power curve shown in FIG. 3. The load share ratios $\alpha_1$ to $\alpha_4$ with respect to the individual rollers are then determined from $PW_R$, and thus the thickness at the outlet of each roller is determined.

(d) Setting of transport time: Upon deciding the rolling speeds of the individual rollers 3a to 3d, the time periods until the material reaches these rollers are calculated. This is so because the speed pattern of the transport table 30 is fixed so that only the speed of the table during rolling is synchronized to the rolling speed.

(e) Setting of rolling pressure and roller gap: The thermal energy possessed by the material is reduced by heat radiation during the transport and rolling of the material. As the transport time being calculated in the step (d), the temperature $T_{out}$ at the outlet of the roller is thus given as a function $$T_{out} = f(T_{in}, H, C_p, \gamma, t) \quad (7)$$

wherein $T_{in}$ is the temperature at the inlet, H is the thickness of the material, $C_p$ is the specific heat of the material, $\gamma$ is the density of the material, and t is the transport time. Thus, the rolling temperature is estimated and the right side of the equation 1 is known so that the rolling force F can be obtained therefrom, and also the roller gap can be obtained from the equation 3.

(f) Setting of the speed $\overline{\Delta Wi}$: Once the thickness reduction schedule is obtained through the above steps, it is possible to calculate the schedule of width increase by the vertical rollers 4. Once the slab width and the goal outlet width in the coarse rolling are given, the spread $\Delta W_i$ in the width direction in the rolling by each roller can be calculated according to an equation $$\Delta W_i = f_{20}(H_i, h_i, W_i, E_i, T_i, D_i) \quad (8)$$

wherein $W_i$ is the width of material at the inlet of vertical roller, $E_i$ is the roller depression value, $T_i$ is the rolling temperature, and $D_i$ is the roller diameter.

(g) Setting of the final breadth reduction value $B_R$: The value $B_R$ in the coarse rolling can be calculated from the result of the step (f) using an equation $$B_R = W_O - W_R + \sum_{i=1}^{M} \Delta W_i \quad (9)$$

wherein $W_0$ is the slab width, $W_R$ is the goal coarse width, and N is the number of coarse rolling passes.

(h) Setting of the rolling depression value, rolling force and roller gap: The value $B_R$ is shared according to given width reduction share ratios, and the results are allotted to the respective vertical rollers 4a to 4d, whereby the reductions are determined for these rollers. In turn, the rolling pressure and roller gap can be obtained using equations similar to those in case of the horizontal rolling.

(i) Setting of fine rollers: The fine rollers 5a to 5f execute sequential rolling but there is no change as to the volume of the material so that the following equation is obtained.

$$h_i \cdot V_i = h_F \cdot V_F \quad (10)$$

wherein $h_i$ is the thickness at the outlet of the i-th roller, $V_i$ is the incoming speed of the material to the i-th roller, $h_F$ is the thickness at the outlet of the roller 5f, and $V_F$ is the outgoing speed of the material from the roller 5f.

It is to be noted that the rolling schedule in the fine rolling, as in the coarse rolling, can also be determined by setting similar power curve, thickness at the fine roller inlet, thickness $h_1$ at the fine roller outlet and power share ratios $\alpha_1$ to $\alpha_4$ for the individual rollers. From this rolling pattern the fine rolling speed can be obtained. Then, the temperature of the material can be calculated from the arrival time at the next roller, in turn the rolling pressure can be obtained, and finally the vertical position of each roller can be determined.

The rolling schedule is determined through the above steps, and the various conditions obtained are supplied from the thermal load monitor 8a to the controllers 7b and 7c. The controllers 7b and 7c control the respective coarse rolling and fine rolling according to the supplied data. During procedure of the rolling, the roller motor current root mean square value is calculated for each pass from the actual motor currents measured during the time between the end of the preceding pass and the beginning of the next pass, and checked for heat load. After checking, the amount of correction of the pitch, at which the materials are taken out from the ovens 1a to 1c, is obtained in the step (b). In this way, the current pitch is progressively corrected.

Now, another embodiment of the control method according to the invention, in which the rolling time is minimized under given conditions, will be described. The method will be described in connection with a reversible rolling mill having a pair of rollers.

(a) Setting of the minimum number of passes P: The minimum number of passes P necessary for rolling the material down to a desired thickness is obtained from the ratio of a given total power to the maximum permissible rolling power of the rolling mill.

$$P = \frac{\text{Total power}}{\text{Maximum permissible rolling power}} \tag{11}$$

(b) Setting of the root mean square value $W_{RMS}$: The root mean square value $W_{RMS}$ of the required rolling power in the minimum rolling time which is selected from the minimum number of passes P as obtained in the step (a) is given as $$W_{RMS} = \sqrt{\sum_{i=1}^{P} \frac{\int_0^{\tau_{Ri}} (KW_{Ri})^2 dt + \int_0^{\tau_{Ii}} (KW_{Ii})^2 dt}{\tau_{Ri} + \tau_{Ii}}} \tag{12}$$

wherein $KW_{Ri}$ is the required rolling power for the i-th pass, $KW_{Ii}$ is the required electrical power during the time between the end of rolling for the i-th pass and the start of rolling for the (i+1)-th pass, $\tau_{Ri}$ is the rolling time required for the i-th pass, and $\tau_{Ii}$ is the no-load idle time for the i-th pass.

(c) Setting of the optimum schedule value: The value $W_{RMS}$ is checked whether $W_{RMS}$ is within the permissible range or not for the rolling mill. If the value is within the range, it is selected as the optimum schedule value. If it is not, the idle time $\tau_{Ii}$ is extended, and looped to the step (b) until the idle time satisfies the above condition as shown by the equation 12. It is to be noted that the root mean square value is calculated for each pass since the temperature of the material varies with the individual passes.

(d) Setting of required power and power sharing ratio for each pass: The required power for each pass is calculated from an equation $$\text{(Power for } i\text{-th pass)} = \text{(Power sharing ratio for } i\text{-th pass)} \times \text{(Total power)} \tag{13}$$

Figure 5:
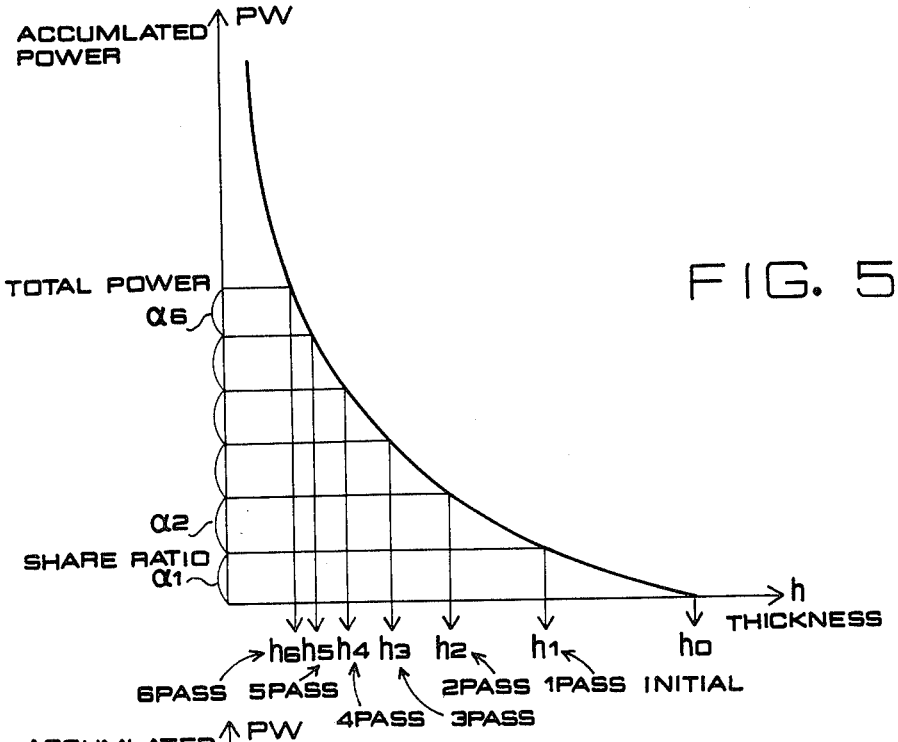
FIG. 5 is a graph showing the relationship between power required for roller and thickness of material.

The power sharing ratio is determined from the maximum number of passes and the capacity of the rolling mill. FIG. 5 shows the relationship between the power sharing ratio and thickness. The thickness at the outlet can be obtained from this graph. It is to be noted that the incoming thickness of the first pass is the initial thickness while the outgoing thickness of each path is the incoming thickness of the next pass.

(e) Setting of the rolling force $F_i$: The rolling force $F_i$ for each pass is calculated using the equation 1.

(f) Setting of power $PW_i$: The power $PW_i$ for each pass is calculated using the equation 2 and the result of the step (e).

(g) Setting of the position $S_i$: The position $S_i$ of roller for each pass is calculated from the incoming thickness $h_i$ and rolling force $F_i$ using the equation 3.

Figure 6:
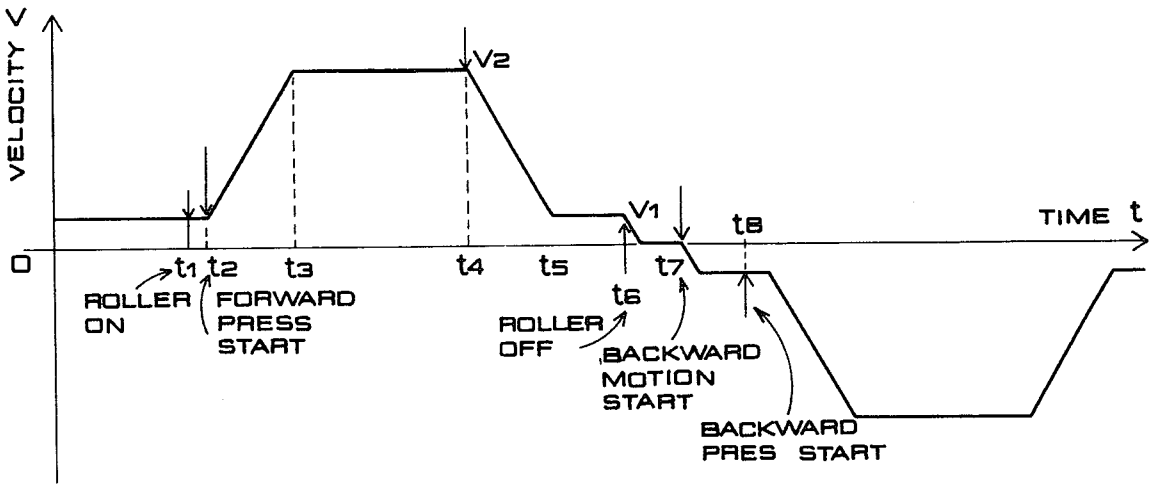
FIG. 6 is a graph showing a rolling speed pattern of the apparatus shown in FIG. 4.

Through the above steps the rolling schedule with a minimum rolling time can be determined. If it is necessary to increase the number of passes, the calculation is begun from the no-load idle time set as the shortest time. FIG. 6 shows a time chart of a typical rolling schedule. In the Figure, $t_1$ represents the instant of the roller "on" for the 1-st pass, $t_2$ represents the acceleration start time, $t_3$ represents the desired rolling speed arrival time, $t_4$ represents the deceleration start time, $t_5$ represents the deceleration complete time, $t_6$ represents the roller "off" time, $t_7$ represents the backward motion start time of roller, and $t_8$ represents the roll "on" time for the next pass. During the period $t_3$–$t_7$, the rolling speed is thus changed to provide three different speeds $V_2$, $V_1$ and 0. The same setting is done for each pass.

Figure 7:
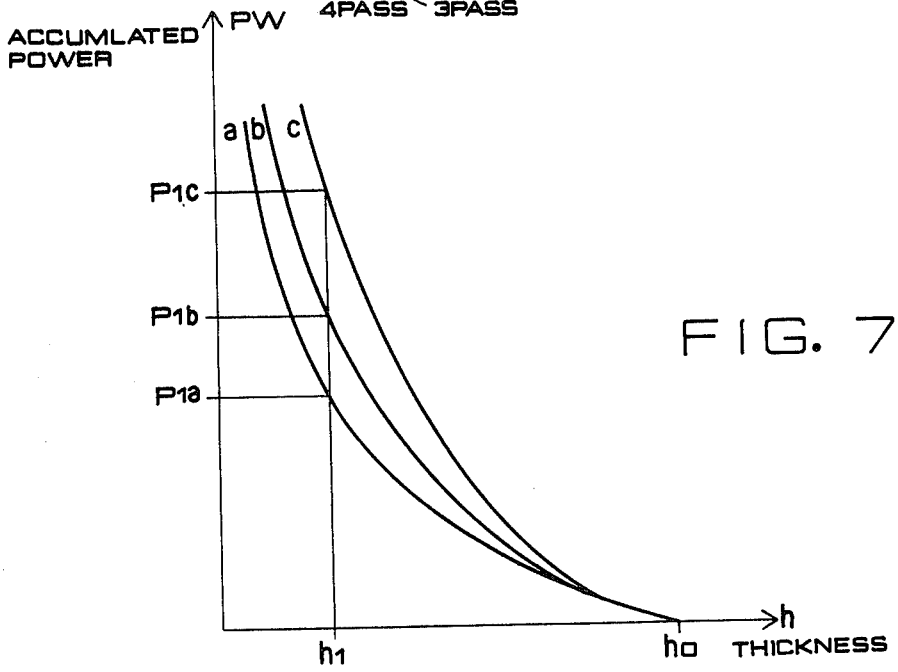
FIG. 7 is a graph showing the relationship between accumulated power and thickness.

FIG. 7 is a graph showing the relationship between the accumulated power and thickness. Curve a is for the case of the minimum idle time, and curves b and c are for cases wherein the idle time is increased by $\Delta t$ and $2\Delta t$ respectively. Labeled $h_0$ is the initial thickness, and $h_1$ the goal thickness. The power values $P_{1a}$, $P_{1b}$ and $P_{1c}$ on the respective curves a, b and c corresponding to the goal thickness $h_1$ are used to approximate the total power required. The rolling schedule that is necessary for determining the number of passes and the goal thickness for each pass is calculated from these curves.

Figure 4:
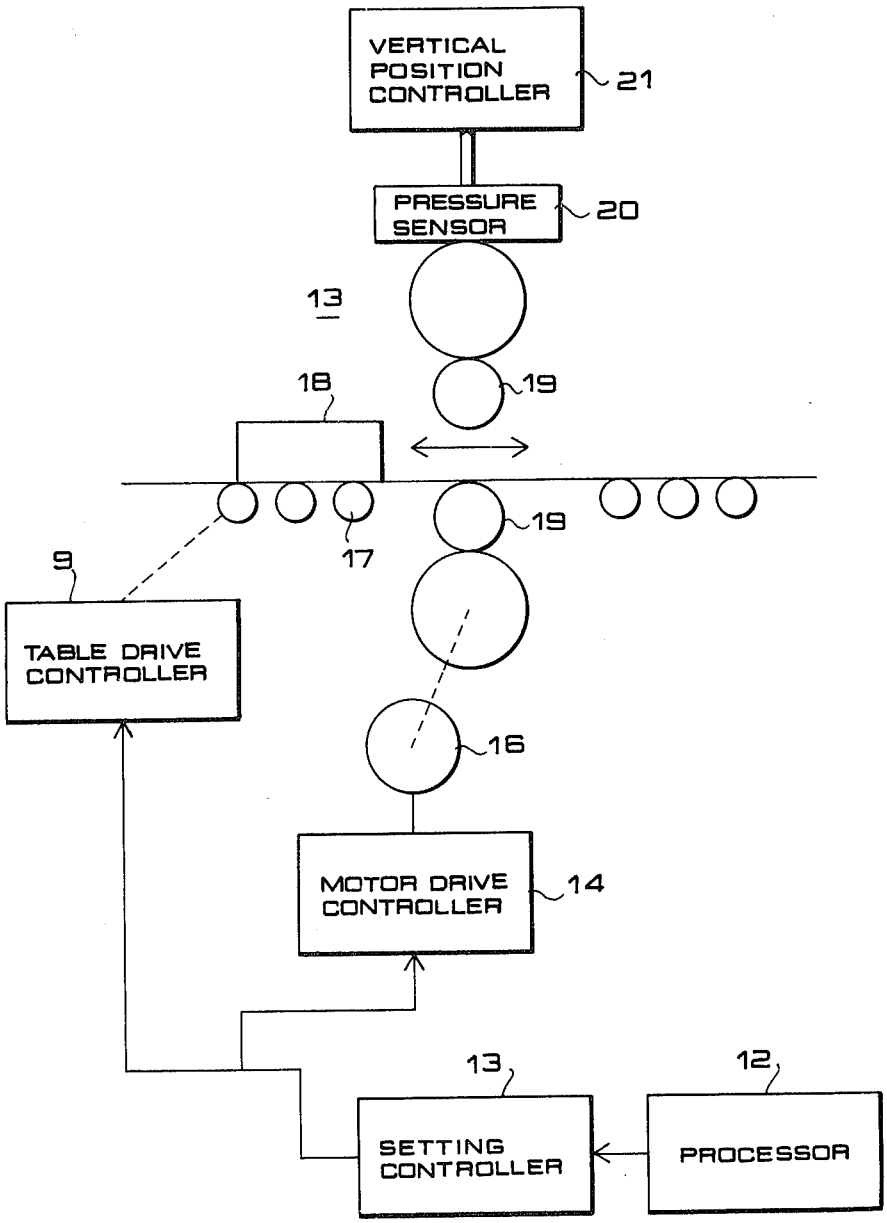
FIG. 4 is a schematic representation of a different rolling apparatus controlled by the method of control according to another embodiment of the invention.

FIG. 4 shows a block diagram of a rolling apparatus based on the second embodiment of the control method described above. A processor 12 executes the steps (a) to (g) mentioned above. The resulting values obtained from the processor 12 are set in a setting controller 13. The setting controller 13 controls a motor drive controller 14 and a table drive controller 15. The motor drive controller 14 controls motor 16, while the table drive controller 15 controls table rollers 17. The material 18 is transported forwards and then backwards on the table rollers 17 to be rolled by roller 19. The vertical position of the roller 19 is controlled by a vertical position controller 21 through a pressure sensor 20.

What is claimed is:

1. A method of controlling extractor means and roller means of a rolling apparatus such that heated materials are successively taken out from heating means and fed to a transport table at a predetermined time interval by said extractor means and rolled to a predetermined thickness by said roller means through a plurality of rolling passes providing respective predetermined gaps, comprising the steps of:

obtaining the root mean square value of electrical power supplied to motor means for driving said roller means during each of said rolling pass; and correcting said interval at which the materials are successively taken out by said extractor means by setting this interval to an amount such that the maximum root mean square value of the power supplied to said motor means is less than the permissible root mean square power value of said motor means in any one of the passes.

2. The method of control according to claim 1, wherein said root mean square value of power is given as $$\frac{\sqrt{\int_{t}^{t+\tau} I_i^2 dt}}{I_{oi}}$$

wherein t is time, $\tau$ is the time duration between the start of rolling in an i-th pass and the start of rolling in an (i+1)-th pass, and $I_{oi}$ is the rated current of said motor means for the i-th pass.

3. The method of control according to claim 2, wherein the amount of correction of said interval is given as $$\frac{\int_{t}^{t+\tau} I_i^2 dt}{I_{RMSO}^2 + I_{oi}^2}$$

wherein $I_{RMSO}$ is the maximum permissible root mean square value of power supplied to said motor means in any one of the passes.

4. A method of controlling extractor means and roller means of a rolling apparatus such that heated materials are successively taken out from heating means and fed to a transport table at a predetermined time interval by said extractor means and rolled to a predetermined thickness by said roller means through a plurality of rolling passes providing respective predetermined gaps, comprising the steps of:

obtaining the minimum number of rolling passes by dividing the total required electrical power supplied to motor means for driving said roller means by the maximum permissible rolling power for said roller means in any one of the passes;

calculating rolling speed and backward motion start timing of said roller means corresponding to selected minimum rolling time;

obtaining the root mean square value of power required for rolling for said selectable rolling time; and correcting idle time of said roller means such that said root mean square value of the required power is less than the required root mean square power value of said motor means in any one of the passes.

5. The method of control according to claim 4, wherein said root mean square value of required power is given as $$\sqrt{\sum_{i=1}^{P} \frac{\int_{o}^{\tau_{Ri}} (KW_{Ri})^2 dt + \int_{o}^{\tau_{Ii}} (KW_{Ii})^2 dt}{\tau_{Ri} + \tau_{Ii}}}$$

wherein $KW_{Ri}$ is the power required for rolling in an i-th pass, $KW_{Ii}$ is the power required during the time between the end of rolling in the i-th pass and the start of rolling in an (i+1)-th pass, $\tau_{Ri}$ is the time required for rolling in the i-th pass, $\tau_{Ii}$ is the idle time in the i-th pass, and P is the number of passes involved.

* * * * *

UNITED STATES PATENT AND TRADEMARK OFFICE

CERTIFICATE OF CORRECTION

PATENT NO. : 4,485,652

DATED : December 4, 1984

INVENTOR(S) : Morio Shoji et al.

It is certified that error appears in the above-identified patent and that said Letters Patent is hereby corrected as shown below:

In the Abstract, line 5, "valve" should read --value--;
line 6, "motor" should read --motors--;
line 7, "valve" should read --value--.

Column 3, equation (4) should read as follows:

$$I_{RMS} = \frac{\sqrt{\dfrac{\int_{t}^{t+\tau} I_i^2 dt}{\tau}}}{I_{oi}} \qquad (4)$$

Column 3, equation (5) should read as follows:

$$P_i t_i = \frac{\int_{t}^{t+\tau} i\, I_i^2 dt}{I_{RMSO}^2 + I_{oi}^2} = t_i \qquad (5)$$

Column 4, line 49, in equation (9), "M" should be --N--.

UNITED STATES PATENT AND TRADEMARK OFFICE

CERTIFICATE OF CORRECTION

PATENT NO. : 4,485,652

DATED : December 4, 1984

INVENTOR(S) : Morio Shoji et al.

It is certified that error appears in the above-identified patent and that said Letters Patent is hereby corrected as shown below:

Column 5, equation (12) should read as follows:

$$W_{RMS}=\sqrt{\sum_{i=1}^{P} \frac{\int_{o}^{\tau_{Ri}} (KW_{Ri})^{2} dt + \int_{o}^{\tau_{Ii}} (KW_{Ii})^{2} dt}{\tau_{Ri} + \tau_{Ii}}} \qquad (12)$$

Column 7, the equation in claim 2 should read as follows:

$$\frac{\sqrt{\int_{t}^{t+\tau} I_i^2 dt}}{I_{oi}}$$

Column 7, the equation in claim 3 should read as follows:

$$\frac{\int_{t}^{t+\tau} I_i^2 dt}{I_{RMSO}^2 + I_{oi}^2}$$

UNITED STATES PATENT AND TRADEMARK OFFICE

CERTIFICATE OF CORRECTION

PATENT NO. : 4,485,652

DATED : December 4, 1984

INVENTOR(S) : Morio Shoji et al.

It is certified that error appears in the above-identified patent and that said Letters Patent is hereby corrected as shown below:

Column 8, the equation in claim 5 should read as follows:

$$\sqrt{\sum_{i=1}^{P} \frac{\int_0^{\tau_{Ri}} (KW_{Ri})^2 dt + \int_0^{\tau_{Ii}} (KW_{Ii})^2 dt}{\tau_{Ri} + \tau_{Ii}}}$$

Signed and Sealed this

*Thirteenth* Day of *August 1985*

[SEAL]

*Attest:*

DONALD J. QUIGG

*Attesting Officer* *Acting Commissioner of Patents and Trademarks*